US009663278B1

(12) United States Patent
Daws, II

(10) Patent No.: US 9,663,278 B1
(45) Date of Patent: May 30, 2017

(54) CONTAINER WITH IMPROVED LOCKING SYSTEM

(71) Applicant: Harold C. Daws, II, Gulf Breeze, FL (US)

(72) Inventor: Harold C. Daws, II, Gulf Breeze, FL (US)

( * ) Notice: Subject to any disclaimer, the term of this patent is extended or adjusted under 35 U.S.C. 154(b) by 0 days.

(21) Appl. No.: 14/970,759

(22) Filed: Dec. 16, 2015

(51) Int. Cl.
*B65D 55/14* (2006.01)
*E05B 67/00* (2006.01)
*E05B 65/52* (2006.01)

(52) U.S. Cl.
CPC ..... *B65D 55/14* (2013.01); *E05B 65/5246* (2013.01); *E05B 67/00* (2013.01)

(58) Field of Classification Search
CPC ..... B65D 55/14; B65D 55/10; B65D 55/02; E05B 65/5246; E05B 65/5207; E05B 65/52; E05B 67/06; E05B 67/00; E05B 67/383; E05B 17/2003; E05C 1/04; E05C 19/182
USPC ..... 220/324, 315, 810; 248/552, 213.2, 248/205.1; 292/104, 205, 148, 346; 70/54, 55, 56, 158, 159, 160, 161, 162
See application file for complete search history.

(56) References Cited

U.S. PATENT DOCUMENTS

| | | | | |
|---|---|---|---|---|
| 1,737,411 | A * | 11/1929 | Deans | H01M 2/043 220/315 |
| 4,290,281 | A * | 9/1981 | Knaack | E05B 67/38 70/159 |
| 5,076,078 | A | 12/1991 | Weger, Jr. | |
| 5,308,126 | A | 5/1994 | Weger et al. | |
| 6,494,046 | B1 | 12/2002 | Hayess | |
| 6,681,604 | B1 | 1/2004 | Samsel | |
| 6,772,613 | B2 | 8/2004 | Webb et al. | |
| 7,318,632 | B2 | 1/2008 | Bidinger et al. | |
| 7,370,890 | B2 | 5/2008 | Samsel | |
| 7,416,228 | B2 | 8/2008 | Pfitzinger et al. | |
| 7,823,741 | B2 | 11/2010 | Bridges et al. | |
| 8,096,152 | B2 | 1/2012 | Wagh et al. | |
| 8,342,580 | B2 | 1/2013 | Cowie et al. | |
| RE44,387 | E | 7/2013 | Bridges et al. | |
| 8,601,838 | B2 | 12/2013 | Hansen et al. | |
| 8,684,421 | B2 | 4/2014 | Cowie et al. | |
| 8,960,814 | B2 | 2/2015 | Bergum et al. | |
| 2014/0123715 | A1 | 5/2014 | Bergum et al. | |
| 2014/0291325 | A1 | 10/2014 | Cowie et al. | |

FOREIGN PATENT DOCUMENTS

GB 2233036 A * 1/1991 ..... E05B 67/38

* cited by examiner

*Primary Examiner* — Robert J Hicks
(74) *Attorney, Agent, or Firm* — GrayRobinson, P.A.; Thomas L. Kautz

(57) ABSTRACT

A locking system for a storage container provides a reliable and durable way of locking the lid in the closed position with a limited number of moving parts while providing resistance to tampering and theft. The locking system includes a housing which receives a padlock having a shackle movable between a locked position and an unlocked position relative to the latch arms of a latch mounted to the lid.

16 Claims, 7 Drawing Sheets

CONTAINER WITH IMPROVED LOCKING SYSTEM

FIELD OF THE INVENTION

This invention relates to storage containers, and, more particularly, to a storage container with an improved locking system.

BACKGROUND OF THE INVENTION

Containers such as tool boxes and storage cabinets are commonly used at construction sites and similar locations for the storage of tools and materials. Typical designs comprise a front wall, a back wall, a bottom wall and opposed end walls which are interconnected to form a hollow interior. The container interior is closed by a top wall or lid pivotal between open and closed positions on a hinge mounted to the back wall, usually with the assistance of gas springs.

Due to the value of tools and materials that may be held in storage containers, one or more locking mechanisms are generally employed to prevent theft. In horizontally oriented containers, it is typical to position a padlock at one or both of the corners of the lid to prevent it from being opened except when the padlock(s) are unlocked. Preferably, structure is provided to shield the padlock(s) from exposure to tampering, such as attempts to cut the shackle or pry open the body of the padlock.

One design of a locking mechanism for storage containers of the type described above is found in U.S. Pat. Nos. 6,772,613 and 8,096,152. Although somewhat different, the locking mechanism disclosed in each of these patents operates by causing a padlock to either block or permit lateral motion of a latch rod located in the interior of the container body relative to flanges mounted to the lid of the container. When lateral movement of the latch rod is blocked by alignment of the body of the padlock with one end of such rod, the latch rod engages the flanges carried by the lid thus preventing the lid from opening. After unlocking the padlock, the latch rod is free to move in a lateral direction without contacting the padlock body such that it disengages the lid flanges allowing the lid to be opened. Locking mechanisms of this type are relatively complex and depend on accurate alignment between a number of elements mounted to the lid and to the body of the container. Over the course of time and as a result of the often demanding conditions at job sites, the lids and bodies of storage containers may become misaligned making operation of latch rod difficult and/or preventing an end of the latch rod to engage the padlock body in order to lock the container.

SUMMARY OF THE INVENTION

This invention is directed to a storage container with a locking system which is reliable and has a limited number of moving parts.

In the presently preferred embodiment, the locking system of this invention comprises a housing which is mounted by a bracket within a cavity formed in each end wall of the container. The housing has an interior which receives a padlock such that the shackle of the padlock extends through openings formed in the housing and bracket, in a direction toward the interior of the container, and the body of the padlock faces outwardly within the cavity. The shackle is movable between an unlocked position wherein the padlock body may be moved into a pocket formed in the housing interior, and a locked position in which the padlock body is located outside of such pocket.

The locking system further comprises a latch, and preferably a spring-biased hawk bill latch, which is mounted to the lid of the container in alignment with the shackle of the padlock. With the shackle in the locked position and the padlock body located outside of the pocket in the housing, the latch arms of the latch engage the shackle in the course of movement of the lid to the closed position. The latch arms open in response to initial contact with the shackle and then close around it when the lid is fully seated on the container body. An opening is provided between the latch arms in the closed position within which the shackle is captured. In order to open the lid, the padlock is unlocked allowing one end of the shackle to disengage the padlock body. The padlock body may then be moved into the pocket of the housing, in a direction toward the interior of the container body, causing the shackle to move in the same direction. In the course of such movement, that portion of the shackle that had been located between the latch arms moves through the opening between them until it clears such arms. With the latch arms no longer encircling the shackle, the lid may be opened.

The locking system of this invention provides a reliable and durable means of locking the lid of storage container, with a limited number of moving parts, while providing resistance to tampering and theft.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
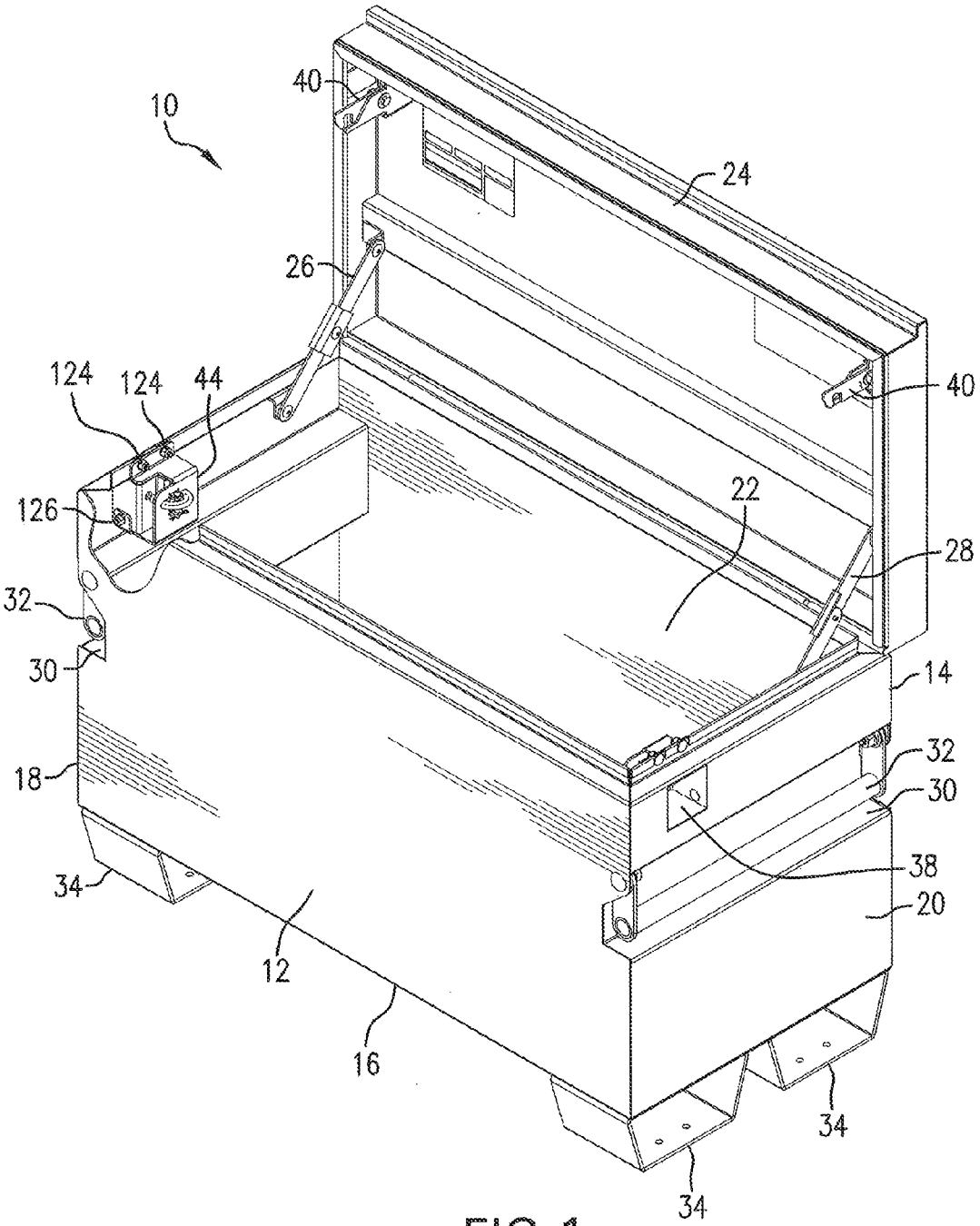
FIG. 1 is a perspective view of a storage container with the locking system of this invention.

Referring initially to FIG. 1, a storage container 10 is illustrated which comprises a front wall 12, a back wall 14, a bottom wall 16 and opposed end walls 18, 20 interconnected to form a hollow interior 22. A lid 24 is mounted by a hinge (not shown) to the back wall 14 and movable between a closed position covering the hollow interior 22, and an open position where it is held in place by support legs 26, 28 connected between the lid 24 and respective end walls 18, 20. Each end wall 18, 20 may be formed with an elongated channel 30 extending between the front and back walls 12, 14 within which a handle 32 is mounted. Preferably, a foot plate 34 is mounted at each corner of the bottom wall 16. For purposes of the present discussion, the terms "top," "bottom," "vertical," "horizontal," "inwardly" and "outwardly" refer to the orientation of the container 10 as shown in the Figs.

The container 10 is locked in the closed position by two locking assemblies 36, each located at a cavity 38 formed in respective ends walls 18, 20, in cooperation with two hawk-bill latches 40 mounted to the lid 24. One locking assembly 36 and one latch 40 are collectively referred to herein as a locking system, and there are two locking systems identical to one another located at each end wall 18, 20 of the container 10 only one of which is described below.

Figure 2:
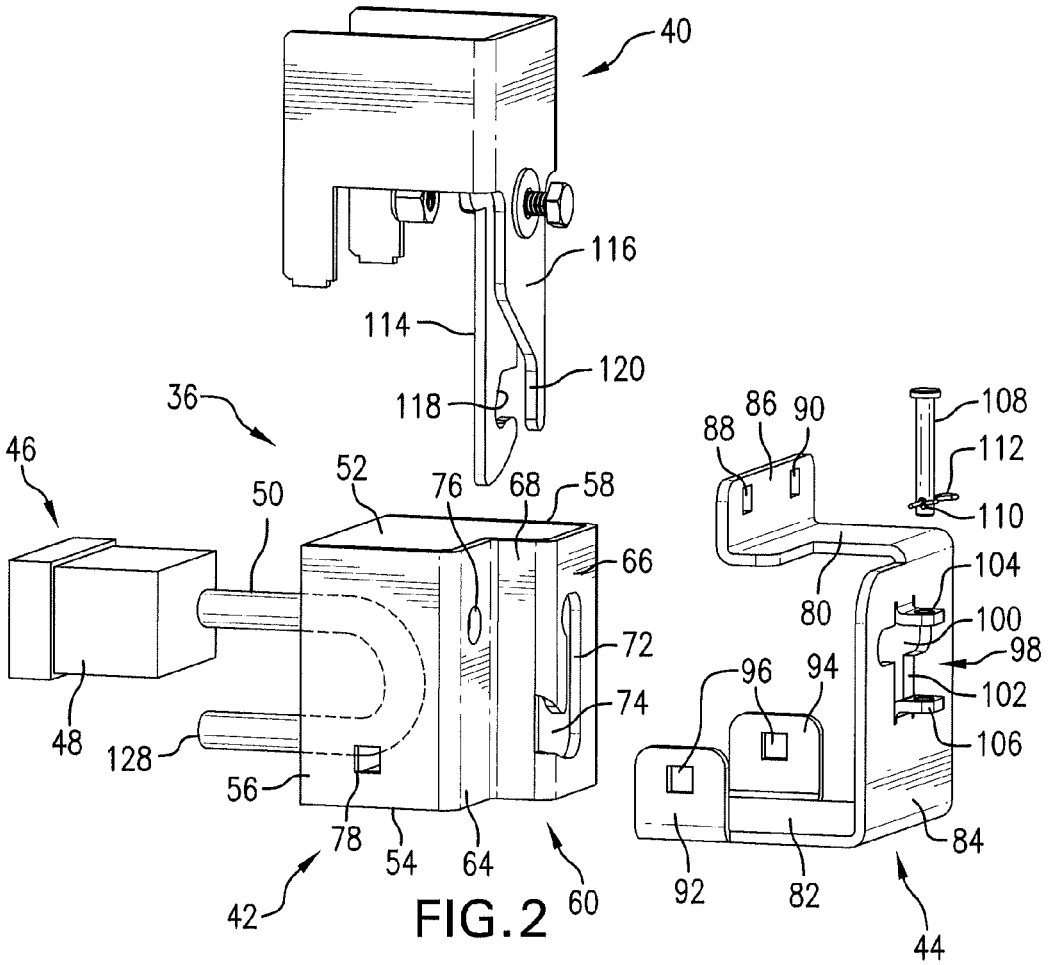
FIG. 2 is an exploded, perspective view of the locking system herein depicted the padlock, housing, bracket and latch mechanism.
Figure 3:
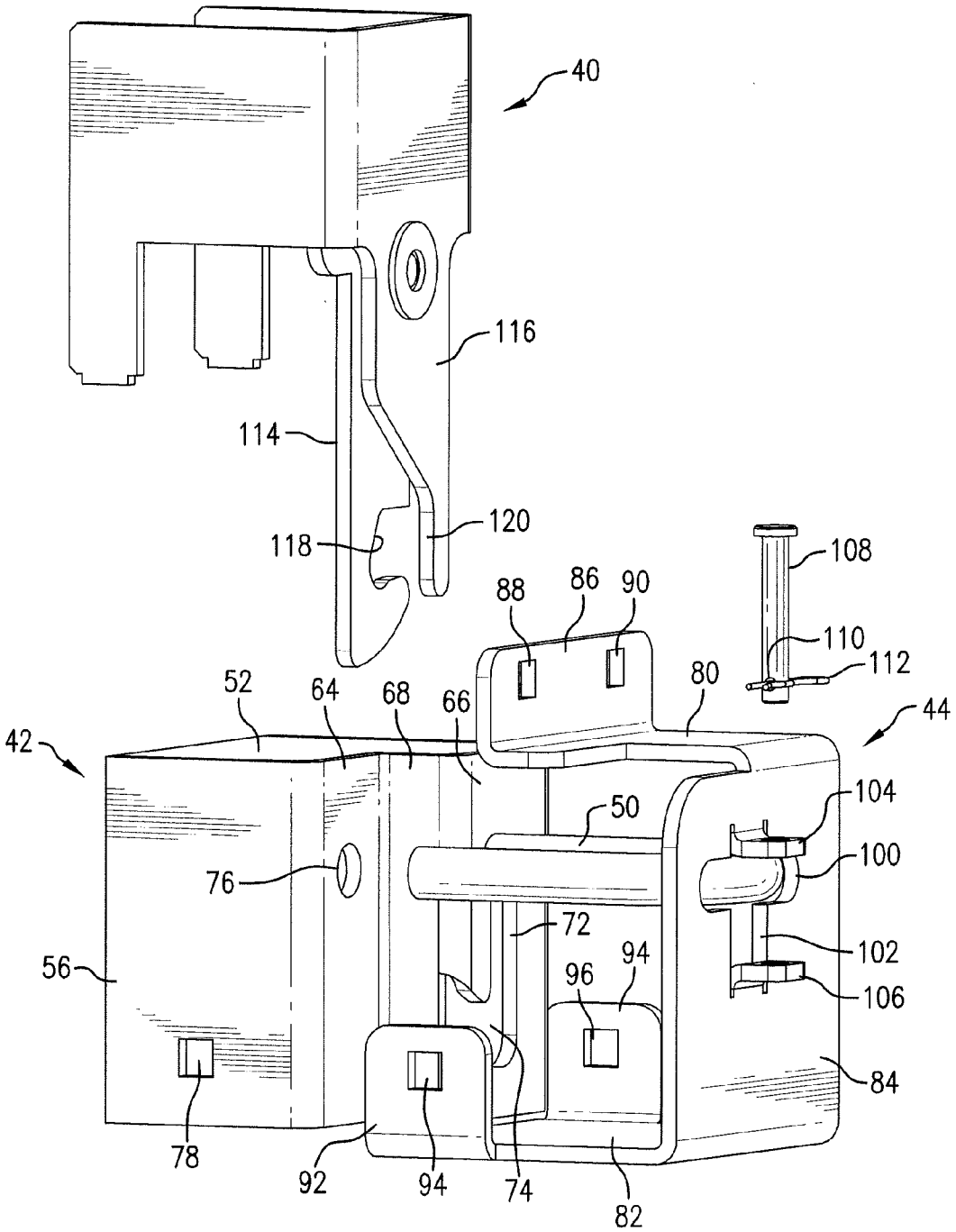
FIG. 3 is a view similar to FIG. 2 except showing the shackle of the padlock having been inserted through a slot in the housing, turned 90°, and then entering a slot in the bracket.
Figure 6:
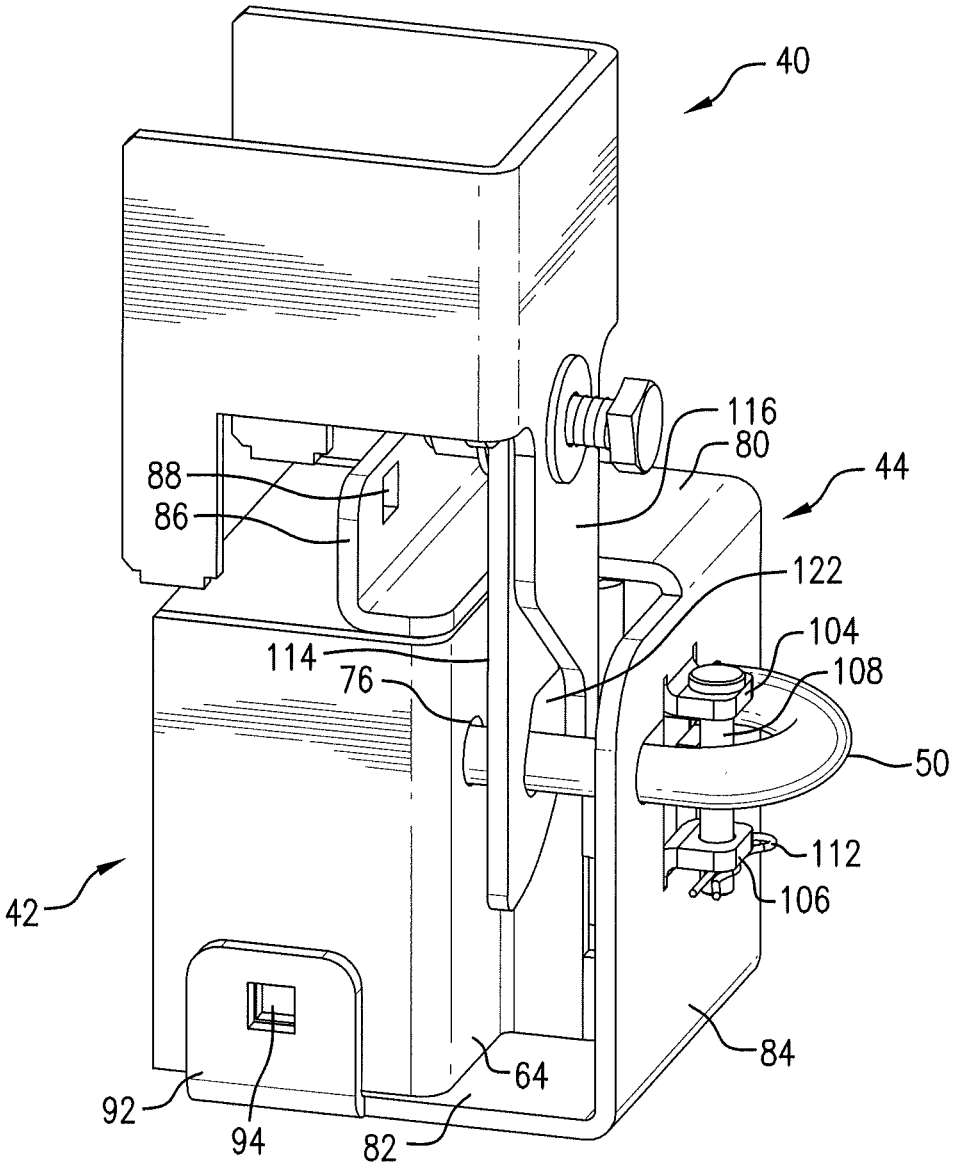
FIG. 6 is a view of the latch mechanism captured by the shackle after closing the container lid.
Figure 8:
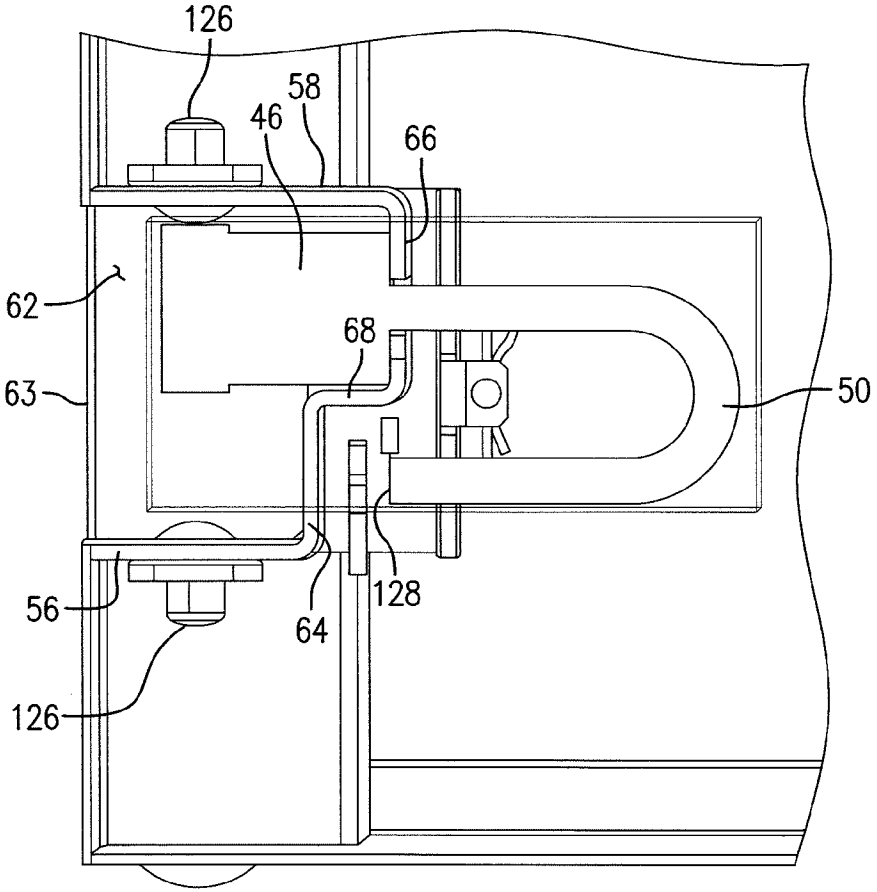
FIG. 8 is a view similar to FIG. 7 except with the shackle unlocked and the padlock body inside of the pocket.
Figure 7:
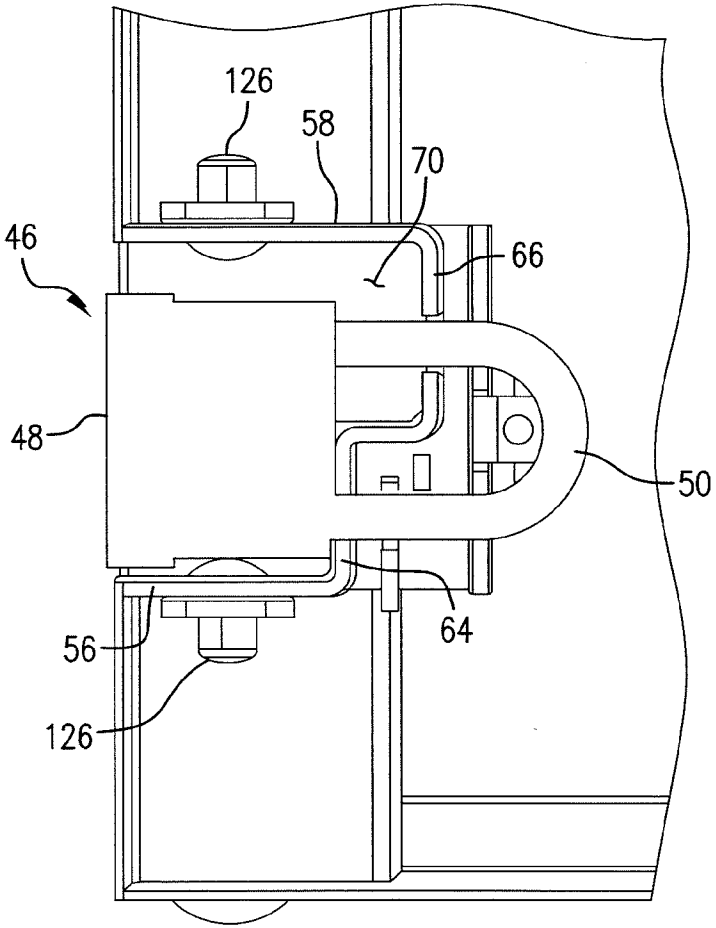
FIG. 7 is a plan view of the locking system mounted to an end wall of the container depicting the shackle in the locked position and the padlock body outside of a pocket in the housing interior.

Referring now to FIGS. 2-8, each locking assembly 36 of this invention comprises a housing 42, a bracket 44 and a padlock 46 having a padlock body 48 and shackle 50. The housing 42 comprises a top wall 52, a bottom wall 54, opposed side walls 56, 58 and a back wall 60 defining an interior 62 having an open front end 63. See FIG. 8. The back wall 60 is formed with a first section 64 joined along one edge to the side wall 56, a second section 66 joined along one edge to the side wall 58 and a middle section 68 connected between the first and second sections 64, 66. As best seen in FIGS. 2, 7 and 8, the side wall 58 is longer than side wall 56, as measured in a direction from the front end 63 of the housing 42 toward the back wall 60, which, together with the second section 66 and middle section 68, forms a pocket 70 within the housing interior 62. Preferably, the second section 66 of the back wall 60 has a vertical slot 72 joined to a generally horizontally extending notch 74. The first section 64 is formed with a hole 76, and each of the side walls 56, 58 is formed with an opening 78.

As depicted in the Figs., the bracket 44 is generally C-shaped having a top plate 80, a bottom plate 82 and a vertical plate 84 connected between the top and bottom plates 80, 82. The top plate 80 has a flange 86 formed with spaced holes 88, 90, and the bottom plate 82 mounts opposed side tabs 92, 94 each formed with a hole 96. The vertical plate 84 is formed with a generally T-shaped opening 98 which includes a horizontal head section 100 and a vertical leg section 102. A pin tab 104 is mounted to the vertical plate 84 at the top of head section 100, and a second pin tab 106 is mounted to the vertical plate 84 at the bottom of leg section 102. These pin tabs 104, 106 receive a retaining pin 108 having a hole 110 for insertion of a cotter pin 112 as described below.

The hawk-bill latches 40 are commercially available and the details of same form no part of this invention. For purposes of the present discussion, each latch 40 includes latch arms 114, 116 which are movable between and open and closed positions, but are normally biased to the closed position by a spring. The lower end of each latch arm 114, 116 is formed with a notch 118, 120, respectively, which collectively define an opening 122 when the latch arms 114, 116 are in the closed position. See FIG. 6.

The housing 42, bracket 44 and padlock 46 are assembled together, and to the container 10, as follows. Initially, and with reference to the left-hand side of FIG. 1, the bracket 44 is connected by fasteners 124 inserted through the holes 88, 90 in flange 86 to the inside of the end wall 18 covering the cavity 38 therein. The shackle 50 of the padlock 46 is uncoupled from the padlock body 48 and placed in a vertical orientation as shown in FIG. 2. The padlock 46 is moved into the interior 62 of the housing 42 so that its shackle 50 extends into the vertical slot 72 in the back wall 60 of the housing 42. Once the padlock 46 is inside of the housing 42 its shackle 50 may then be turned 90° within the horizontally extending notch 74 to assume the position shown in FIG. 3.

The housing 42 and padlock 46, with the now horizontally oriented shackle 50, are moved in an inward direction toward the interior 24 of container 10 so that the bottom wall 54 of the housing 42 slides along the bottom plate 82 of bracket 44, its top wall 52 slides along the top plate 80 of bracket 44, and, the shackle 50 enters the head section 100 of the T-shaped opening 98 in the vertical plate 84 of bracket 44. See FIG. 3. Once the second section 66 of the back wall 60 of housing 42 contacts the vertical plate 84 of bracket 44, the shackle 50 assumes the position depicted in FIG. 4 and the holes 96 formed in tabs 92, 94 of bracket 44 align with the openings 78 formed in respective side walls 56, 58 of the housing 42. Fasteners 126 are insertable through the aligning holes 96 and openings 78 to secure the housing 42 and bracket 44 together. See FIGS. 7 and 8. Additionally, with the shackle 50 in the position shown in FIG. 4, the retaining pin 108 may be inserted into the pin tabs 104, 106 carried by the vertical plate 84 of bracket 44 and then secured in place by inserting the cotter pin 112 into the hole 110 in pin 108. This prevents the padlock 46 from being pulled in an outward direction and disengaging the bracket 44.

Figure 4:
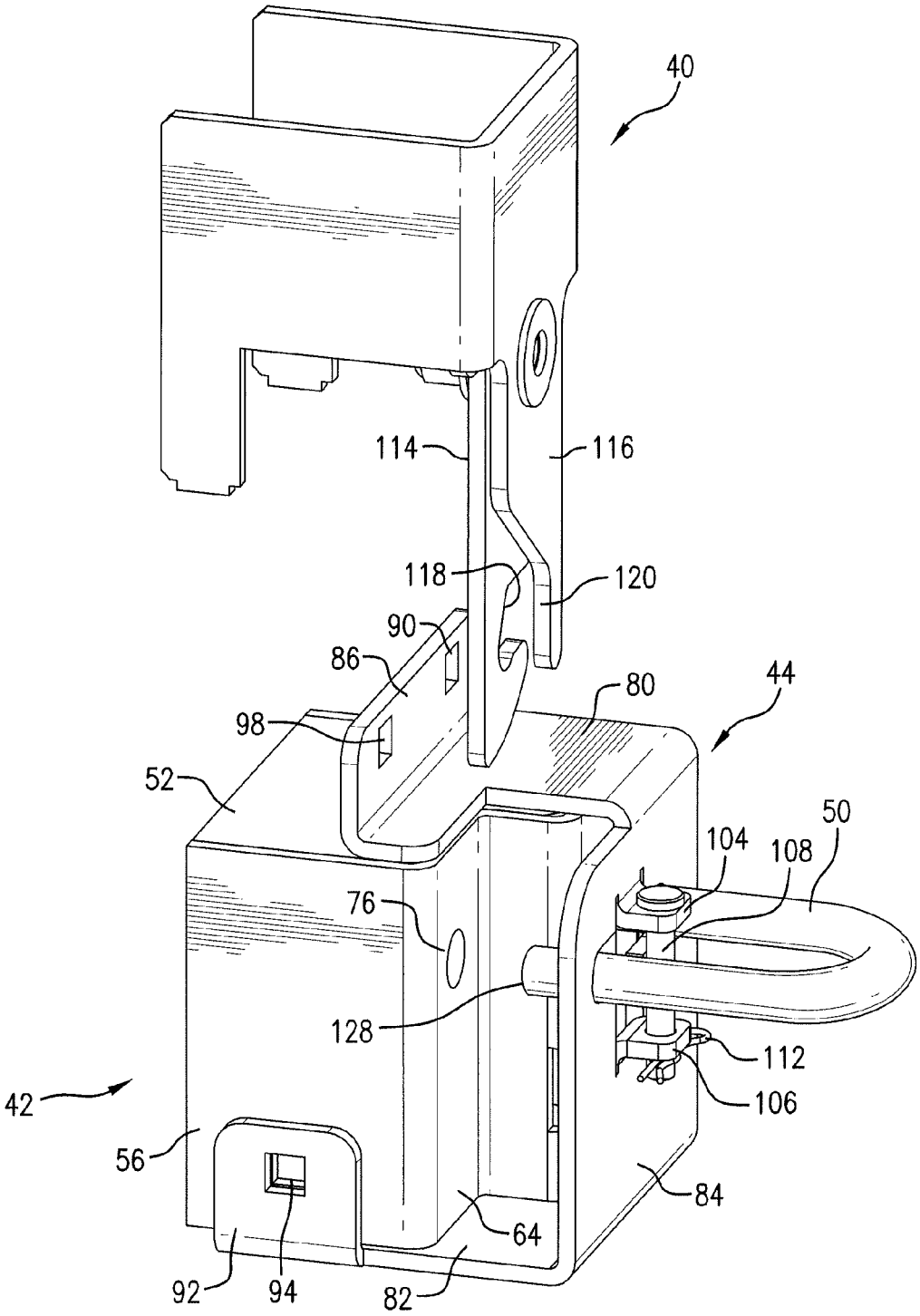
FIG. 4 is a view similar to FIG. 3 with the housing and bracket assembled and the shackle in an unlocked position.
Figure 5:
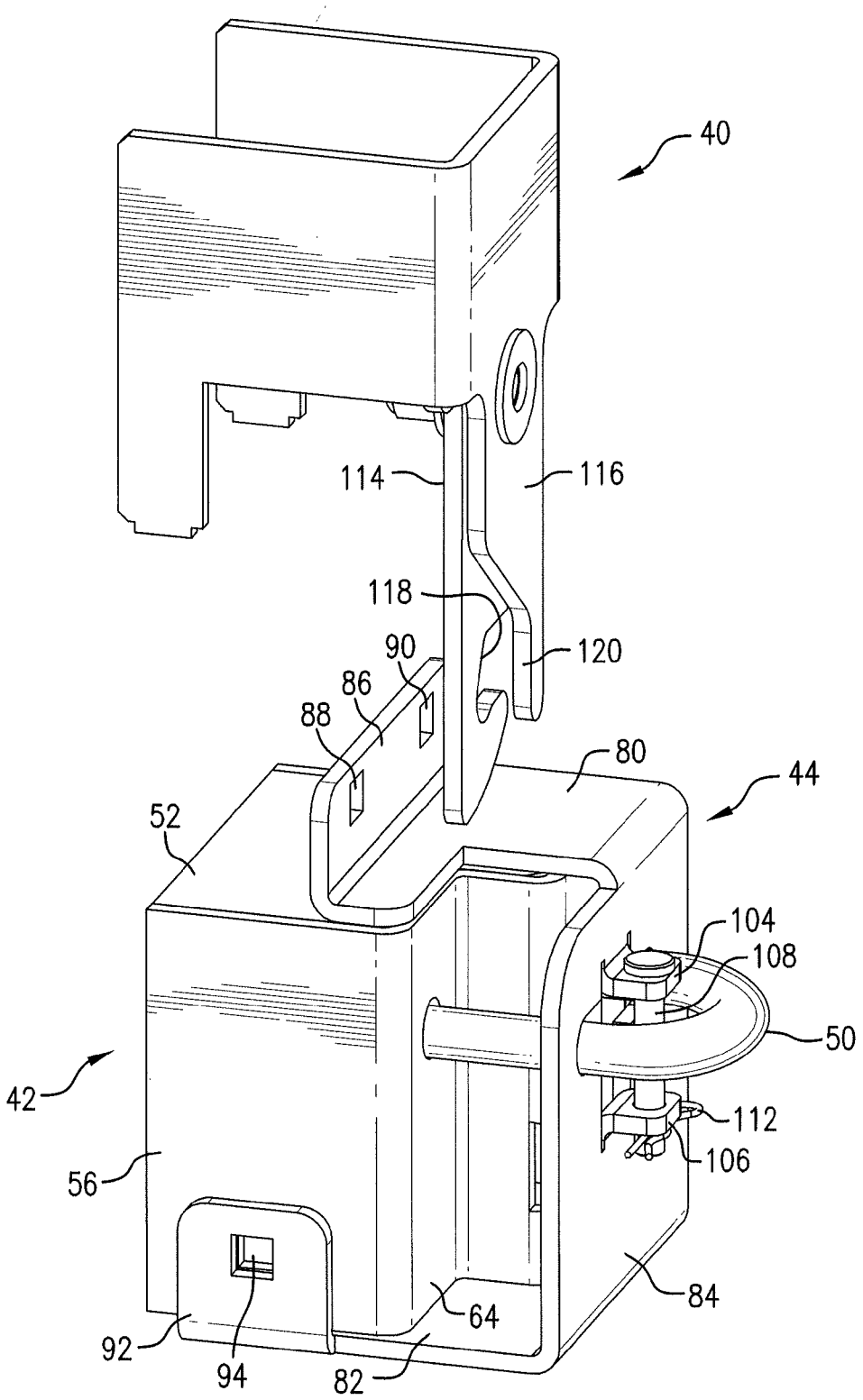
FIG. 5 is a view similar to FIG. 4 except with the shackle in a locked position.

FIGS. 4 and 7 depict the padlock 46 in an unlocked condition wherein the free end 128 of its shackle 50 is spaced from and aligns with the hole 76 in the first section 64 of the back wall 60 of housing 42. The padlock 46 is locked by inserting the free end 128 through hole 76 into the padlock body 48. See FIG. 5. As illustrated in FIG. 7, when the padlock 46 is locked its padlock body 48 is oriented substantially horizontally and located outside of the pocket 70 in the interior 62 of housing 42.

With reference to FIG. 6, with the padlock 46 in the locked position the lid 24 of the container 10 may be moved to the closed position carrying with it latch 40. As the lid 24 moves downwardly, the latch arms 114, 116 contact the shackle 50 and are spread apart against the bias of the spring that normally urges them together. Further downward movement of the lid 24 positions the latch arms 114, 116 so that their respective notches 118, 120 each extend around the shackle 50 causing it to become encircled by the opening 122 collectively formed by such notches 118, 120. In this position, the shackle 50 prevents the lid 24 from being opened.

In order to unlock the container 10, and allow lid 24 to be opened, the padlock 46 is unlocked by a key (not shown) inserted into the padlock body 48 within the cavity 38 in the end wall 18 (and end wall 20) of housing 42. Unlocking the padlock 46 causes the shackle 50 to disengage the padlock body 48 allowing it to be turned about 90° to the orientation shown in FIG. 8. When in this position, the padlock body 48 may be pushed in an inward direction, toward the container interior 24, and into the pocket 70 in the housing 42. The shackle 50 moves in the same direction with the padlock body 48 as it is pushed inwardly so that the portion of the shackle 50 which had been encircled by the latch arms 114, 116 passes through the opening 122 between them. Once the shackle 50 clears the latch arms 114, 116, as illustrated in FIG. 8, the lid 24 may be opened. The shackle 50 and padlock body 48 may remain in the position shown in FIG. 8 with the lid 24 opened or closed in order to permit use of the container 10 without having to unlock it. In order to lock the container 10, one may push the shackle 50 in an outward direction, away from the container interior 24, by reaching inside of the container 10 and grasping the shackle 50. After the padlock body 48 is outside of pocket 70, it may be rotated back to the position shown in FIG. 7 and the free end 128 of shackle 50 may be inserted through the hole 76 in back wall 60 of housing 42 into the padlock body 48. See FIGS. 5 and 7. The padlock 46 is then ready to receive the latch 40 as discussed above.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A container, comprising:

a container body having a front wall, a back wall, a bottom wall and opposed end walls interconnected to define a hollow interior, a lid connected to said container body and being movable between an open position and a closed position relative to said hollow interior;

a locking system effective to lock said lid in said closed position, said locking system comprising:

(i) a bracket mounted to said lid or to one of said front wall and opposed end walls, said bracket being formed with an opening;

(ii) a housing mounted to said bracket, said housing having an interior and being formed with an opening;

(iii) a padlock including a padlock body and a shackle having a free end, said shackle movable between a locked position in which said free end is inserted within said padlock body and an unlocked position in which said free end disengages said padlock body, said shackle being insertable through said opening in said housing and through said opening in said bracket so that said padlock body is located within said interior of said housing;

a latch mechanism mounted to the other of said lid or to said front wall or opposed end walls, said shackle of said padlock being effective when in said locked position to capture said latch mechanism upon movement of said lid to said closed position, said latch mechanism being released by said shackle allowing said lid to move to said open position after movement of said shackle to said unlocked position.

2. The container of claim 1 in which said housing comprises a top wall, a bottom wall, opposed side walls and back wall defining said interior of said housing with a pocket located within said interior thereof, said back wall being formed with said opening in said housing.

3. The container of claim 2 in which said opening of said housing includes a first slot and a second slot oriented generally perpendicular to one another.

4. The container of claim 3 in which said opening in said bracket includes a head section and a leg section, said head section being oriented substantially perpendicular to said first slot of said opening in said housing.

5. The container of claim 4 in which said bracket includes a first pin tab located at said head section and a second pin tab located at said leg section.

6. The container of claim 5 further including a retainer connected between said first and second pin tabs and extending between said shackle and said bracket with said shackle inserted through said opening in said bracket.

7. The container of claim 5 in which said shackle when in said unlocked position is insertable through said first slot of said opening in said housing and then turned within said second slot so that said shackle may be inserted into and through said head section of said opening in said bracket.

8. The container of claim 2 in which said housing is formed with a hole, said free end of said shackle being insertable through said hole and into said padlock body to place said shackle in said locked position, said padlock body when in said locked position being located outside of said pocket formed in said interior of said housing.

9. The container of claim 8 in which said free end of said shackle disengages said padlock body with said shackle in said unlocked position, said padlock body being movable into said pocket formed in said interior of said housing with said shackle unlocked to permit movement of said shackle to a position wherein said latch mechanism may be released.

10. The container of claim 9 in which said latch mechanism includes a first latch arm and a second latch arm movable between an open position and a closed position, said first and second latch collectively forming an opening when in said closed position, said first and second latch arms being movable to said open position in the course of movement of said lid to said closed position and upon engagement with said shackle when in said locked position, said first and second latch arms being movable to said closed position after engagement with said shackle wherein said shackle is captured within said opening formed by said first and second latch arms.

11. The container of claim 10 in which said free end of said shackle passes through said opening between said first and second latch arms of said latch mechanism in the course of movement of said padlock body into said pocket in said interior of said housing so that said first and second latch arms no longer capture said shackle thus allowing said lid to be moved to said open position.

12. A container, comprising:

a container body having a front wall, a back wall, a bottom wall and opposed end walls interconnected to define a hollow interior, a lid connected to said container body and being movable between an open position and a closed position relative to said hollow interior;

a locking system effective to lock said lid in a closed position, said locking system comprising:

(i) a bracket mounted to said lid or to one of said front wall and opposed end walls, said bracket being formed with an opening;

(ii) a housing mounted to said bracket, said housing having an interior formed with a pocket, said housing having a back wall formed with an opening;

(ii) a padlock including a padlock body and a shackle having a free end, said shackle being movable between a locked position in which said free end is inserted within said padlock body and an unlocked position in which said free end disengages said padlock body, said shackle when in said unlocked position being insertable through said opening in said back wall of said housing and through said opening in said bracket so that said padlock body is located within said interior of said housing;

a latch mechanism mounted to the other of said lid or to said front wall or said opposed end walls, said latch mechanism having first and second latch arms movable between an open position and a closed position, said shackle when in said locked position being positioned relative to said first and second latch arms with said padlock body located outside of said pocket so that in the course of movement of said lid to said closed position said first and second latch arms first engage said shackle, move toward said open position and then move back to said closed position wherein said shackle is captured between them, said shackle being movable to said unlocked position wherein said padlock body is movable into said pocket causing said free end of said shackle to clear said first and second latch arms so that said lid may be moved to an open position.

13. The container of claim 12 in which said opening in said back wall of said housing includes a first slot and a second slot oriented generally perpendicular to one another, said opening in said bracket being formed with a head section which is generally perpendicular to said first slot.

14. The container of claim 13 in which said shackle is insertable through said first slot in said housing and then turned substantially perpendicularly within said second slot thereof into alignment with said head section of said opening in said bracket.

15. The container of claim 13 in which said bracket includes a first pin tab located at said head section of said opening in said bracket and a second pin tab spaced from said first pin tab, said first and second pin tabs receiving a retainer pin which extends between said bracket and said shackle to prevent said shackle from disengaging said bracket.

16. The container of claim 14 in which said padlock body is positioned in a first orientation when located outside of said pocket and in said locked position, and said padlock body is located in a second orientation when located inside of said pocket and in said unlocked position, said first and second orientations of said padlock body being substantially perpendicular to one another.

* * * * *